US009047777B2

(12) United States Patent
Im et al.

(10) Patent No.: US 9,047,777 B2
(45) Date of Patent: Jun. 2, 2015

(54) METHOD AND SYSTEM FOR PROVIDING INFORMATION ABOUT PARKING SPACE THROUGH COMMUNICATION BETWEEN VEHICLES

(71) Applicant: Hyundai Motor Company, Seoul (KR)

(72) Inventors: Seongsu Im, Gyeonggi-do (KR); Yoonho Jang, Seoul (KR); Jaekwang Kim, Seoul (KR); Kang Hoon Lee, Gyeonggi-do (KR)

(73) Assignee: Hyundai Motor Compnay, Seoul (KR)

( * ) Notice: Subject to any disclaimer, the term of this patent is extended or adjusted under 35 U.S.C. 154(b) by 240 days.

(21) Appl. No.: 13/710,140

(22) Filed: Dec. 10, 2012

(65) Prior Publication Data

US 2014/0118167 A1 May 1, 2014

(30) Foreign Application Priority Data

Oct. 26, 2012 (KR) ..... 10-2012-0119993

(51) Int. Cl.

| | |
|---|---|
| ***G08G 1/00*** | (2006.01) |
| ***G08G 1/14*** | (2006.01) |
| ***G08G 1/09*** | (2006.01) |
| ***G08G 1/0967*** | (2006.01) |

(52) U.S. Cl.

CPC ..... *G08G 1/143* (2013.01); *G08G 1/092* (2013.01); *G08G 1/096716* (2013.01); *G08G 1/096758* (2013.01); *G08G 1/096791* (2013.01)

(58) Field of Classification Search

CPC ..... G08G 1/096716; G08G 1/096758; H04W 84/18

USPC ..... 340/901–905, 933, 937, 539.1

See application file for complete search history.

(56) References Cited

U.S. PATENT DOCUMENTS

| | | | | |
|---|---|---|---|---|
| 2007/0061192 | A1* | 3/2007 | Chew | 705/13 |
| 2008/0010018 | A1* | 1/2008 | Satonaka et al. | 701/300 |

FOREIGN PATENT DOCUMENTS

| | | | |
|---|---|---|---|
| JP | 2008269358 | A | 11/2008 |
| JP | 2011065279 | A | 3/2011 |
| JP | 2011209779 | A | 10/2011 |
| KR | 10-2010-0029985 | | 3/2010 |

* cited by examiner

*Primary Examiner* — Daryl Pope

(74) *Attorney, Agent, or Firm* — Mintz Levin Cohn Ferris Glovsky and Popeo, P.C.; Peter F. Corless

(57) ABSTRACT

Disclosed herein is a system and method for providing information about a parking space through communication between vehicles the method including broadcasting, by a controller, a parking space information request message within a predetermined range, using the communication adapter, when a request signal is input by a driver; receiving, by the controller, information about an available parking space received by unicast communication in response to the broadcasted request message; and outputting, by the controller, the information about an available parking space to the driver.

17 Claims, 11 Drawing Sheets

METHOD AND SYSTEM FOR PROVIDING INFORMATION ABOUT PARKING SPACE THROUGH COMMUNICATION BETWEEN VEHICLES

CROSS-REFERENCE TO RELATED APPLICATION

This application claims priority to and the benefit of Korean Patent Application No. 10-2012-0119993 filed in the Korean Intellectual Property Office on Oct. 26, 2012, the entire contents of which are incorporated herein by reference.

BACKGROUND OF THE INVENTION (a) Field of the Invention

The present invention relates to a method and system for providing information about a parking space, and more particularly, a method and system for providing information about a parking space through communication between vehicles that provides information about a parking space.

(b) Description of the Related Art

As known in the art, many cities have insufficient parking spaces for the large number of vehicles in the city. Drivers often must search for an empty parking place, when parking at a department store, a parking lot of a large mart, a residential street crowded with vehicles, a downtown, and a side street.

Department stores and large marts are equipped with systems for providing information about parking spaces, such as informing drivers of the number of empty parking spaces on each floor or in each line. However, a system for providing information about parking spaces does not exist on residential streets, side streets, or downtown in a crowded city. Despite available parking spaces in these areas, it may be difficult to provide and manage accurate information about parking spaces, even if systems are constructed in those areas.

The parking management systems in large buildings such as a department store use a technology that recognizes information on an empty parking space through radio frequency identification (RFID), an image, or other sensors, and provides drivers with information through an electric bulletin board. Those systems require many sensors that sense location information and vehicle information in the parking facility and a server that manages the sensors.

On the other hand, an unparked status communication system between a plurality of vehicles has been developed. However, the system transmits unparked information only for a predetermined time or only from predetermined distance during parking, it cannot provide information about parking spaces that have been empty for a longer period of time. Further, the system cannot provide information to a vehicle out of the communication area because it uses only 1-hop communication.

The above information disclosed in this section is only for enhancement of understanding of the background of the invention and therefore it may contain information that does not form the prior art that is already known in this country to a person of ordinary skill in the art.

SUMMARY

The present invention has been made in an effort to provide a method and system for providing information about a parking space through communication between vehicles which allow a driver to rapidly park without the inconvenience of searching for a parking space, by giving information about a parking space transmitted by communication between vehicles to the driver when approaching a parking area while driving in an environment where the driver has difficulty in recognizing a parking space.

An exemplary embodiment of the present invention provides method and system for providing information about a parking space through communication between vehicles, allowing vehicles to recognize a parking space that has been empty for a longer period of time by transmitting unparked information to the vehicles, using communication between vehicles.

Another embodiment of the present invention provides method and system for providing information about a parking space through communication between vehicles, which allow vehicles to update information about a parking space, when a new vehicle is parked in the parking space.

Yet another embodiment of the present invention provides method and system for providing information about a parking space through communication between vehicles which allow vehicles around an empty parking space to store information about the empty parking space and to transmit the information about the parking space in multi-hop, when receiving a message requesting information about an available parking location from a new vehicle to be parked.

Yet another embodiment of the present invention provides method and system for providing information about a parking space through communication between vehicles which use a battery as a power source and use a low-power operation type of media access control (MAC) layer used for a wireless sensor network that may operate with low power.

In the description of an exemplary embodiment of the present invention, an empty parking space may be defined as a space that is currently empty, although a vehicle was parked in the space for a predetermined period of time.

An embodiment of the present invention provides a method of providing information about a parking space through communication between vehicles each equipped with a communication adapter that may perform broadcast and unicast communication, wherein the method may include: a predetermined range, by using the communication adapter, when a signal for requesting information about a parking space is input; receiving information about an available parking space received by unicast communication in response to the broadcasted request message; and outputting the information about available parking to a driver. The outputting of information about available parking may display the location of the available parking space by controlling a navigation device in the vehicle.

Another embodiment of the present invention provides a method of providing information about a parking space to a vehicle searching for a parking space by using a communication adapter that may perform broadcast and unicast communication between vehicles, wherein the method may include: receiving a parking space request message through the broadcast communication; checking whether information about an available parking space is stored in a memory, when receiving the broadcasted parking space information request message; transmitting the information about an available parking space through unicast communication corresponding to the broadcasted parking space information request message, when information about an available parking space is stored in the memory; and rebroadcasting the received parking space information request message, when information about an available parking space is not stored in the memory.

The method may further include: receiving information about an available parking space received by the unicast communication in response to the rebroadcasted request message; and transmitting the information about an available parking through unicast communication corresponding to the broadcasted parking space information request message.

Another embodiment of the present invention provides a method of providing information about a parking space through communication between vehicles each equipped with a communication adapter that can perform broadcast and unicast communication, wherein the method may include: broadcasting a parking space information request message by using the communication adapter of a vehicle to be parked, when a signal for requesting information about a parking space is input by the driver of the vehicle; checking whether information about an available parking space is stored in a memory of a plurality of parked vehicles, when the communication adapters of the parked vehicles receive a parking space information request message broadcasted by the vehicle to be parked; unicasting the information about an available parking space to the communication adapter of the vehicle to be parked, which has broadcasted the parking space information request message, through the communication adapter of the parked vehicle with a memory storing the information about an available parking; rebroadcasting the received parking space information request message within a predetermined range, by the parked vehicle with a memory that does not store the information about an available parking space; and updating the memory of the parked vehicle of which the memory stores the information about an available parking space, when the vehicle to be parked which has received the information about an available parking space transmitted in unicast is parked in the available parking space based on the information about an available parking. The rebroadcasting may be performed within a predetermined number of hops.

The method may further include: broadcasting an information message about a vehicle D that is unparked, through the communication adapter of the vehicle D, to update the information about an available parking by distributing the information message about the vehicle that is unparked to vehicles A, B, C, E, and F parked in the surrounding area; broadcasting an acknowledgement signal for the information message about unparking first through the communication adapter of the parked vehicle C closest to the vehicle D that is unparked, when the communication adapters of the vehicles A, B, C, E, and F parked in the surrounding area receive the broadcasted information message about unparking; determining that other parked vehicles A, B, E, and F are not closest to the vehicle D that is unparked, after receiving the acknowledgement signal broadcasted by the parked vehicle C, and then not broadcasting an acknowledgement signal for the information message about unparking broadcasted by the vehicle that is unparked; broadcasting first the acknowledgement signal for the broadcasted information message about unparking, by the parked vehicle C, and then storing the information about unparking of the vehicle D, to a memory as information about an available parking space; and storing information about the vehicle D and the values of reception strength of the broadcasted information message about unparking, in memories of the other vehicles A, B, E, and F, based on the information message about unparking broadcasted by the vehicle D.

The method may further include: broadcasting information about a relatively remote available parking space through the communication adapter, when at least two items of information about an available parking space are stored in the memory; checking whether an acknowledgement signal (e.g., an acknowledgement) has been broadcasted from the communication adapter of another parked vehicle, when a communication adapter receives the broadcasted information about a remote available parking space; not broadcasting an acknowledgement signal relating to the information about a remote available parking space, when the communication adapter has received the acknowledgement signal broadcasted by the communication of another vehicle; broadcasting an acknowledgement signal relating to the information about a remote available parking space through the communication adapter, when the communication adapter has not received the acknowledgement signal broadcasted from the communication adapter of another vehicle; and storing the information about a remote available parking space to the memory as information about an available parking space, after broadcasting the acknowledgement signal relating to the information about a remote available parking space. Unparking of the vehicle may be determined based on signals relating to a parking brake, a shift lever, and a vehicle speed.

The information message about unparking may include the IP (Internet Protocol) of the communication adapter of the vehicle, information about the location of the vehicle, information about the location of the available parking space stored in the memory, and the IP of the communication adapter of the most recently parked vehicle in the available parking space stored in the memory. The information about the location of the available parking space may be obtained by a global positioning system (GPS) in the vehicle. The broadcasting of an acknowledgement signal may be performed based on backoff of RSSI (Received Signal Strength Indication) of the information message about unparking received by the communication adapter.

Another embodiment of the present invention provides a system for providing information about a parking space mounted on vehicles to provide information about a parking space among the vehicles, wherein the system may include: a communication adapter that may perform broadcast and unicast communication; a GPS that may provide information about the location of an available parking space; a navigation device that may display and guide the location of the available parking space; a parking brake switch that may provide a signal according to an operation of a parking brake; a vehicle speed sensor that may detect the speed of a vehicle; a shift lever position detector that may detect the position of a shift lever; and a controller that may provide information about a parking space among the vehicles, based on signals from the communication adapter, the GPS, the parking brake switch, the vehicle speed sensor, and the shift lever position detector, in which the controller may be a controller that is operated by a predetermined program and the program may be composed of a series of commands for performing the method according to another embodiment of the present invention.

As described above, according to an exemplary embodiment of the present invention, a driver may rapidly park without the inconvenience of searching for a parking space, by receiving information about a parking space transmitted by communication between vehicles to the driver approaching a parking area while driving in an environment where the driver has difficulty in recognizing a parking space or when there is no system for a parking management system.

Further, according to an exemplary embodiment of the present invention, it is possible to make vehicles parked in the surrounding area recognize an empty parking space by transmitting unparked information to the vehicles parked in the surrounding area, using communication between vehicles, when a parked vehicle is driven out from the parking area.

Further, according to an exemplary embodiment of the present invention, vehicles in the surrounding area may update information about a parking space, when a new vehicle is parked in the parking space.

DETAILED DESCRIPTION OF THE EMBODIMENTS

Figure 1:
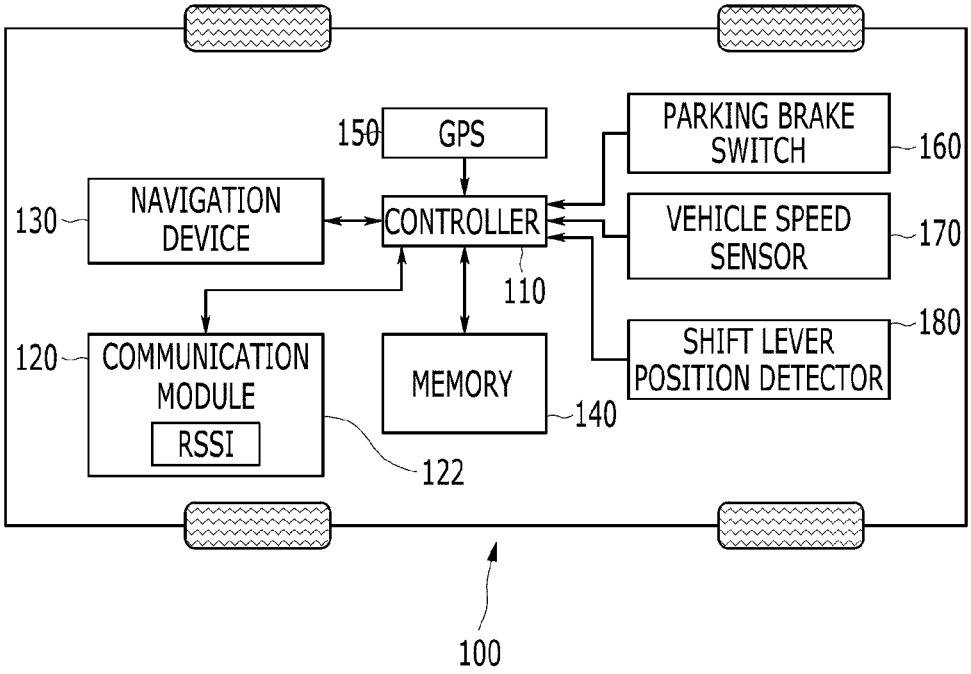
FIG. 1 is an exemplary diagram illustrating the configuration of a system for providing information about a parking space disposed in vehicles, according to an exemplary embodiment of the present invention.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Additionally, it is understood that the term controller refers to a hardware device that includes a memory and a processor. The memory is configured to store the adapters and the processor is specifically configured to execute said adapters to perform one or more processes which are described further below.

Furthermore, the control logic of the present invention may be embodied as non-transitory computer readable media on a computer readable medium containing executable program instructions executed by a processor, controller or the like. Examples of the computer readable mediums include, but are not limited to, ROM, RAM, compact disc (CD)-ROMs, magnetic tapes, floppy disks, flash drives, smart cards and optical data storage devices. The computer readable recording medium can also be distributed in network coupled computer systems so that the computer readable media is stored and executed in a distributed fashion, e.g., by a telematics server or a Controller Area Network (CAN).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

When a part includes a component throughout the specification, it means the part may further include another component, not excluding another component, if not specifically stated. Further, it is assumed that the vehicle stated throughout the specification is equipped with a system for providing information about a parking space according to an exemplary embodiment of the present invention, if not specifically stated. Therefore, when a vehicle is stated throughout the specification, it may be assumed that the system for providing a parking space is in operation.

FIG. 1 is an exemplary diagram illustrating the configuration of a system for providing information about a parking space disposed in vehicles to provide information about a parking space among vehicles, according to an exemplary embodiment of the present invention.

A system for providing information about a parking space according to an exemplary embodiment of the present invention is a system that provides information about an available parking space through communication between vehicles.

The system for providing information about a parking space may include: a communication adapter 120 configured to perform a broadcast and a unicast communication; a GPS 150 configured to provide information about the location of an available parking space and other locations (e.g., locations of vehicles); a navigation device 130 configured to display the location of an available parking space for guiding a driver to the available parking space; a memory 140 configured to store the information about a parking space and other information; a parking brake switch 160 configured to provide a signal generated by operating a parking brake; a vehicle speed sensor 170 configured to detect the speed of a vehicle; a shift lever position detector 180 configured to detect the position of a shift lever; and a controller 110 configured to provide information about a parking space among vehicles based on the signals from the communication adapter 120, the GPS 150, the parking brake switch 160, the vehicle speed sensor 170, and the shift lever position detector 180.

Although the communication adapter 120 may be an integral unit that can perform both the broadcast communication and the unicast communication or may be implemented by combining a adapter performing only broadcast communication with a adapter performing unicast communication, it should be understood that the scope of the present invention is not limited thereto. The scope of the present invention may be applied to the configuration, when the communication adapter performs broadcast and unicast information in response to control signals in a vehicle.

Figure 7:
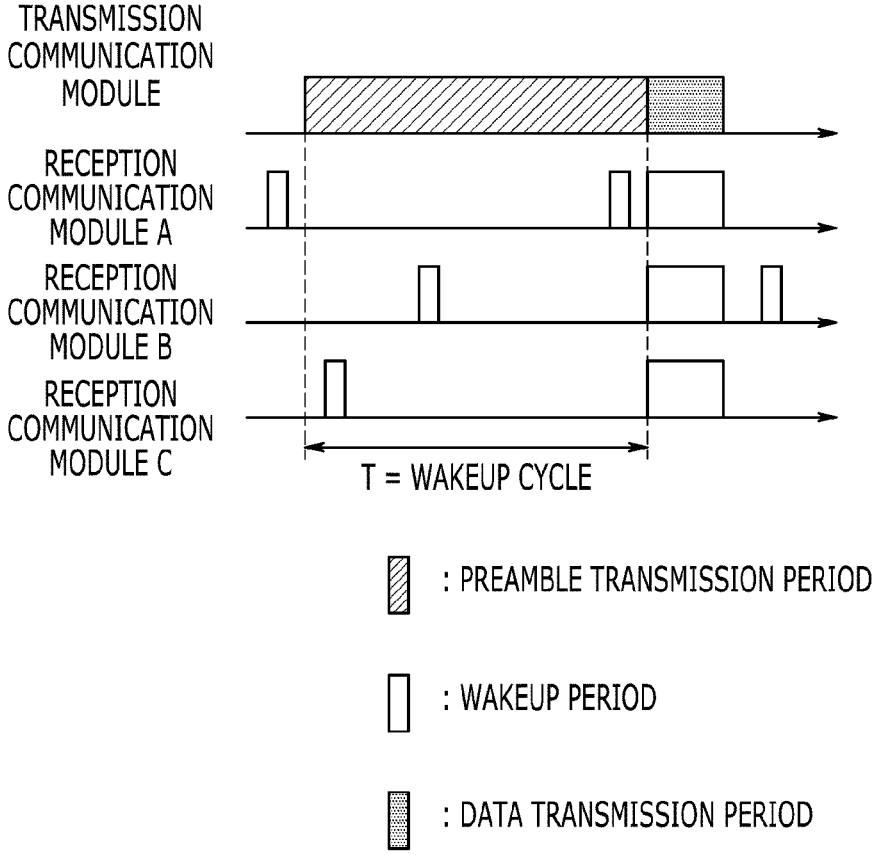
FIG. 7 is an exemplary timing graph illustrating the operation type of a communication adapter, according to an exemplary embodiment of the present invention.

In an exemplary embodiment of the present invention, the communication adapter 120 may achieve low power, using the following method in the MAC layer operation method of an asynchronous wireless sensor network, as shown in FIG. 7.

In other words, the communication adapter 120 operates with a predetermined cycle (e.g., 0.1%). For example, the communication adapter 120 may turn on the chip of the communication adapter 120 only for 1 ms every second, and may turn off the chip for the other periods. Further, the communication adapter may use an asynchronous method that does not synchronize the time points of wakeup between communication adapters to remove consumption of energy for synchronization.

The communication adapter 120 may repeatedly transmit a preamble for the time of a wakeup cycle to transmit a message to all receiving communication adapters in the surrounding area, which asynchronously wake up to transmit a message. In this process, the time left until data is transmitted to the preamble is included in the cycle. A CSMA/CA (Carrier Sense Multiple Access/Collision Avoidance) method may be used to prevent conflict that may occur when several transmitting communication adapters simultaneously transmit messages.

The communication adapter 120 may include an RSSI (Received Signal Strength Indicator) to detect the magnitude of a received signal.

An alternative to a GPS may be used when a GPS 150 is disposed in a vehicle, but it should be understood that the protective scope of the present invention is not limited thereto. The technology and configuration of GPSs are apparent to those skilled in the art and are not described in detail. Additionally, an alternative to a navigation device may be used when the navigation device 130 may display an electronic map for an available parking space based on signals from a GPS in a vehicle and may guide the driver to the available parking space, but it should be understood that the protective scope of the present invention is not limited thereto. The technology and configuration of navigation systems are apparent to those skilled in the art and are not described in detail.

Furthermore, an alternative memory may be used when the memory 140 may read/write information or data such as a random access memory (RAM) or an erasable programmable read only memory (EPROM), but it should be understood that the protective scope of the present invention is not limited thereto. The memory 140 may be included in the controller. Moreover, a variety of switches may be used when the parking brake switch 160 may output on/off signals corresponding to the operation of the parking brake, but it should be understood that the protective scope of the present invention is not limited thereto. The scope of the present invention may be applied to a switch, when the switch may output signals corresponding to the operation of the parking brake, in other words, pulling and unlocking the parking brake, when the signals are not on/off signals.

The vehicle speed sensor 170 may be, as an example, a vehicle speed sensor attached to a wheel which may detect the rotational speed of the wheel or may be a vehicle speed sensor attached to a driven reduction gear of a transmission, but it should be understood that the protective scope of the present invention is not limited thereto. The scope of the present invention may be applied to the configuration, when a value corresponding to the actual vehicle speed may be calculated.

The shift lever position detector 180 may be mounted on a transmission or a shift gear and is configured to detect the location of the shift lever. For example, the present invention may be applied, when the detector may detect the actual position of a shift lever, even when not mounted on a transmission or a shift gear.

The controller 110 may be a controller operating based on a predetermined program and the predetermined program may be constructed by a series of commands for performing the method of providing information about a parking space through communication between vehicles according to an exemplary embodiment of the present invention, which is described below.

In an exemplary embodiment of the present invention, the controller 110 may be included in a BCM (Body Control Adapter) (not shown) and may be configured to control the electric devices of a vehicle, the navigation device 130, or the communication adapter 120.

Hereinafter, a method of providing information about a parking space according to an exemplary embodiment of the present invention is described in detail with reference to the accompanying drawings.

Figure 2:
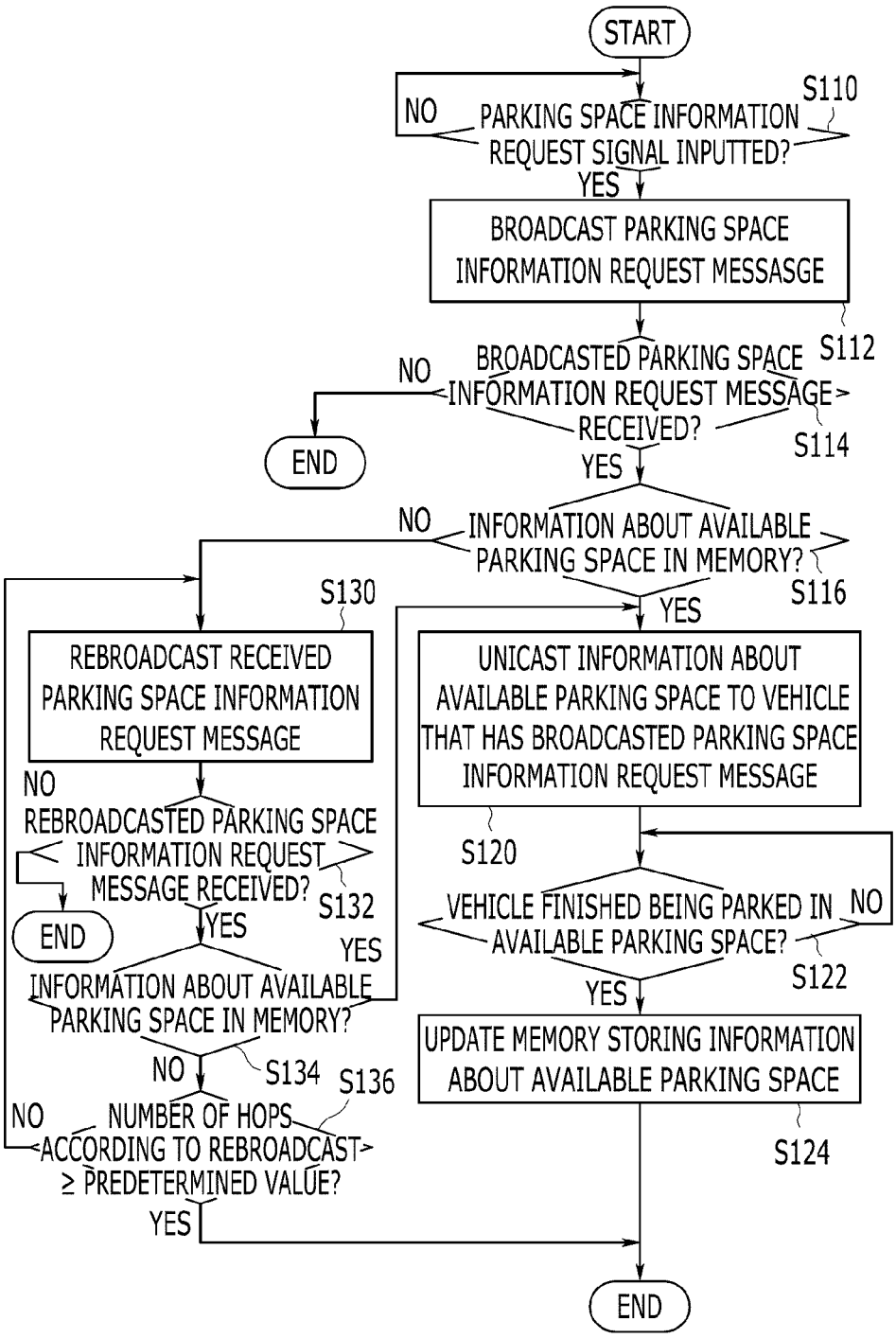
FIG. 2 is an exemplary flowchart illustrating a method of providing information about a parking space through communication between vehicles, according to an exemplary embodiment of the present invention.

FIG. 2 is an exemplary flowchart illustrating a method of providing information about a parking space through communication between vehicles, according to an exemplary embodiment of the present invention. It may be assumed that the vehicles 100 are equipped with the system for providing information about a parking space illustrated in FIG. 1, in describing a method of providing information about a parking space according to an exemplary embodiment of the present invention.

As illustrated in FIG. 2, when a user of the vehicle 100 inputs a signal for requesting information about a parking space (S110), the controller 100 may control a communication adapter 120 to broadcast a parking space information request message within a predetermined range (S112). The vehicle requesting the information about a parking space in step S112 is the vehicle K in FIG. 8.

The user of the vehicle may generate the signal for requesting the information about a parking space, using a separate switch (not shown) in the vehicle, but it should be understood that the protective scope of the present invention is not limited thereto. The scope of the present invention may be applied to another switch that may input a signal for requesting information about a parking space to the controller 110.

Figure 6:
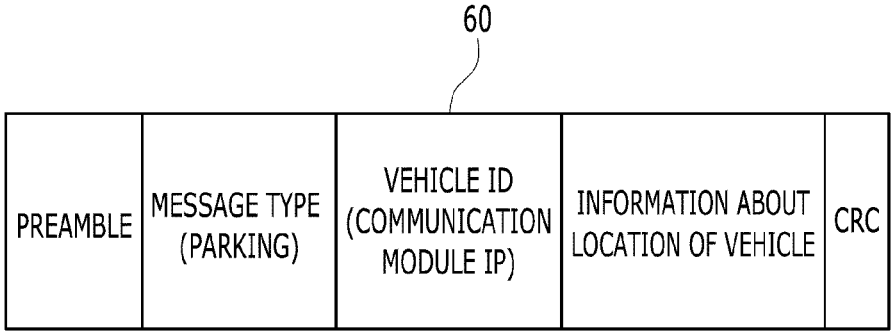
FIG. 6 is an exemplary diagram illustrating the configuration of an unparked information message, according to an exemplary embodiment of the present invention.

When the signal for requesting the information about a parking space is input to the controller 110, the controller 110 may control the communication adapter 120 to broadcast a parking space information request message 60 having the structure illustrated in FIG. 6 within a predetermined range (e.g., radius of 15 m).

The parking space information request message 60 may include, as illustrated in FIG. 6, a preamble, a message type (e.g., a parking request), an IP of the communication adapter mounted in the vehicle as an identification (ID) of the vehicle, the vehicle location information provided by the GPS 150, and CRC (Cyclic Redundancy Check) in an exemplary embodiment of the present invention, but it should be understood that the protective scope of the present invention is not limited thereto. The present invention may be applied to another structure that may be a message structure for requesting information about a parking space.

In an exemplary embodiment of the present invention, the vehicle location information may be location information provided by the GPS 150 and stored in the memory 140. When the parking space information request message 60 is broadcasted within a predetermined range through the communication adapter 120 from the vehicle K to be parked, as illustrated in FIG. 10, the communication adapters 120 in other vehicles parked within the predetermined range may receive the parking space information request message (S114).

When the communication adapters 120 in the vehicles parked within the predetermined range receive the parking space information request message, the controllers 110 of the vehicles receiving the message may determine whether information about an available parking space is stored in the memory 140 (S116). When the available parking space is stored in the memory 140, the controller 110 may control the communication adapter 120 to unicast the determination of storage to the communication adapter of the vehicle that broadcasted the parking space information request message (S120).

Figure 10:
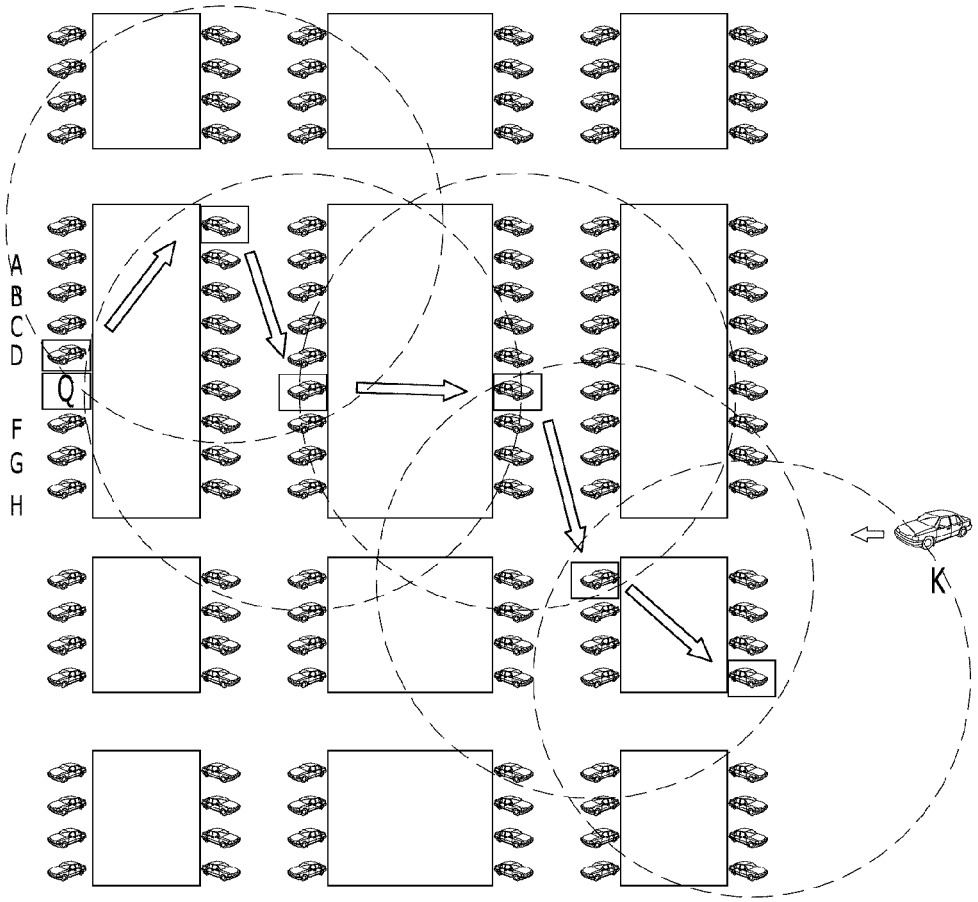

The vehicle including the information about an available parking space in the memory 140 may be vehicle D, for example, in FIG. 10, and the path for the unicast communication is the path connected by the arrows. The available parking space is the place indicated by Q in FIG. 10.

When the vehicle K receiving the information about an available parking space by unicast is parked in the available parking space Q (S122), the controller 110 of the vehicle K may control the communication adapter 120 to broadcast to the vehicles in the surrounding area that vehicle K is parked in the available parking space Q. When the communication adapter 120 of the vehicle K broadcasts that the vehicle has been parked in the available parking space Q, the communication adapter 120 of the vehicle D may receive that information and the controller may delete and update the information about the available parking space stored in the memory 140 (S124).

On the other hand, when the information about an available parking space is not stored in the memory 140 of the corresponding vehicle in step S116, the controller 110 of the vehicle may control the communication adapter 120 to rebroadcast the received parking space information request message within a predetermined range, as illustrated in FIG. 10 (S130). FIG. 10 illustrates when the parking space information request message has been transmitted to the vehicle D by repeating rebroadcast five times. In an exemplary embodiment of the present invention, rebroadcast may be performed within the predetermined number of hops (e.g., ten times).

When the parking space information request message is rebroadcasted within a predetermined range, the communication adapters 120 of the vehicles parked within the predetermined range for the rebroadcast may receive the parking space information request message (S132). When the communication adapters 120 of the vehicles parked within the predetermined range for the rebroadcast receive the parking space information request message, the controllers 110 of the vehicles receiving the message may determine whether information about an available parking space is stored in their memories 140 (S134). The controller 110 of the vehicle having the information about an available parking in the memory 140, as the result of determining in step S134, may control the communication adapter 120 to unicast that the memory includes the information of the available parking to the communication adapter 120 of the vehicle that has broadcasted the parking space information request message (S120).

When the information about an available parking space is not stored in the memory 140, as the result of determining in step S134, the controller of the corresponding vehicle may determine the number of hops that the parking space request message received by the communication adapter 120 has been rebroadcasted and transmitted (S136). When the number of hops for the rebroadcast is less than a predetermined number of times, the process described above may be repeated. Alternatively, if the number of hops for the rebroadcast is larger than the predetermined number times, the communication adapter 120 of the corresponding vehicle does not rebroadcast the parking space information request message.

Figure 3:
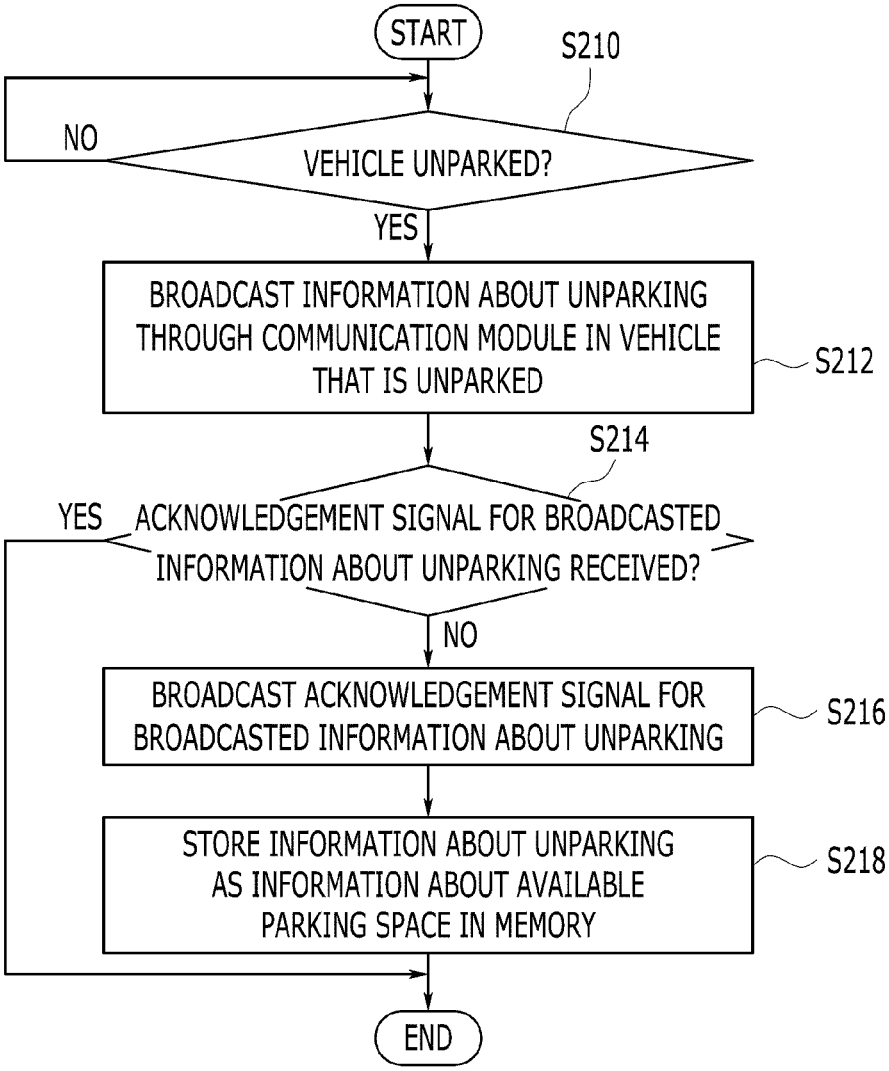
FIG. 3 is an exemplary flowchart illustrating a method of providing information about a parking space through communication between vehicles, according to another exemplary embodiment of the present invention.
Figure 9:
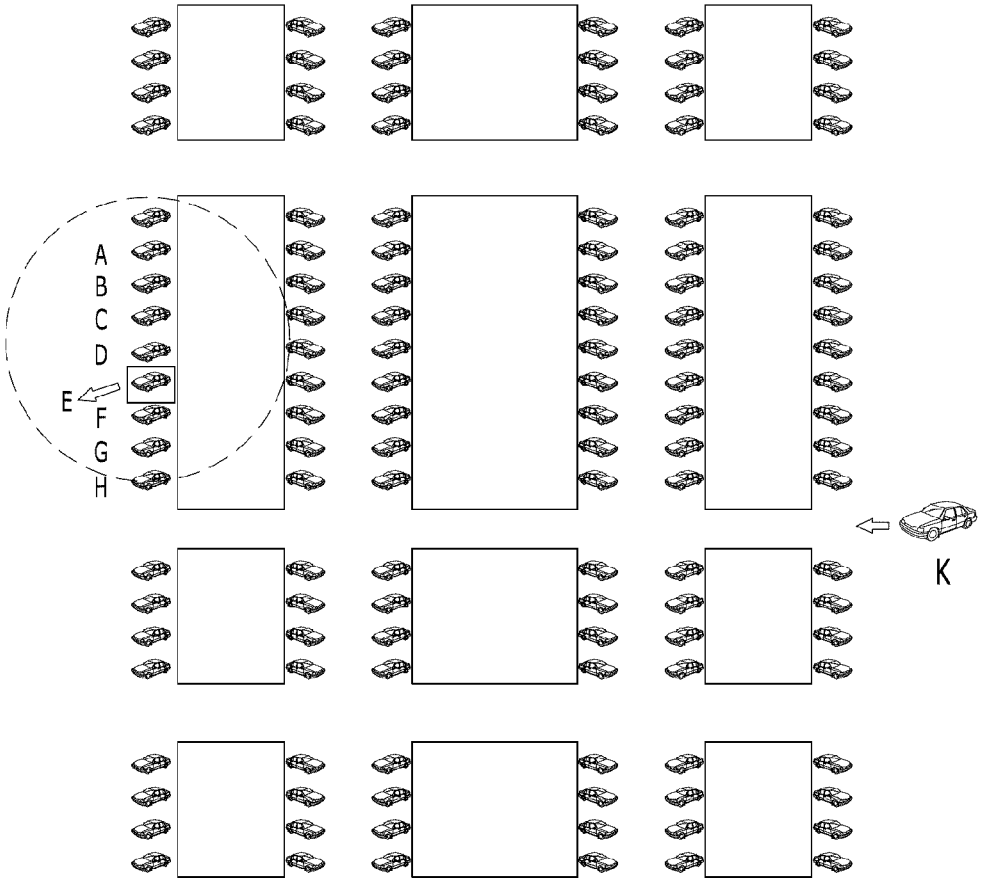
Figure 11:
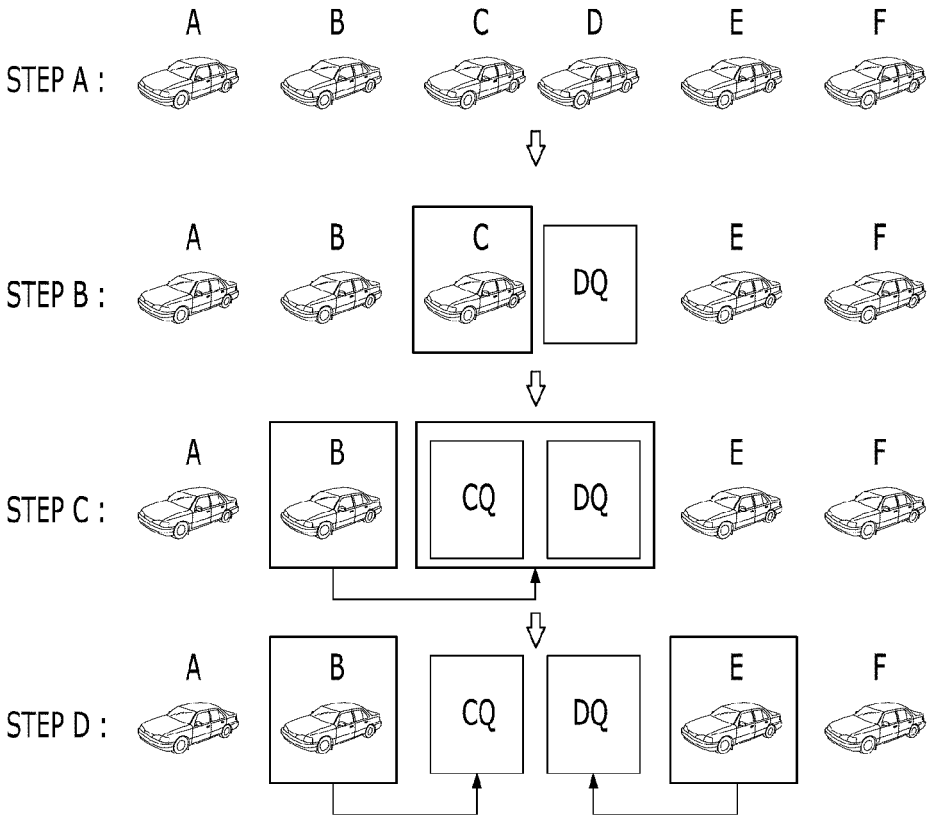

Referring to FIGS. 3, 9, and 11, when an area is unparked, the controller 110 of the vehicle that is being unparked (e.g., the vehicle is exiting the parking space) may control the communication adapter 120 to broadcast an information message of the unparking within a predetermined range (S210 and S212). The vehicle to be unparked is the vehicle E in FIG. 9 and the vehicle to be unparked is the vehicle D in FIG. 11. Unparking of a parked vehicle may be determined based on signals from the parking brake switch 160, the vehicle speed sensor 170, and the shift lever position detector 180. The controller 110 may determine that a vehicle is unparked, for example, when a signal for unlocking the parking brake lever is input to the controller 110 from the parking brake switch 160, a signal for the shift lever at the driving range (D-range) is input from the shift lever position detector 180, and a signal for a vehicle speed at a predetermined vehicle speed or more is input from the vehicle speed sensor 170.

Figure 5:
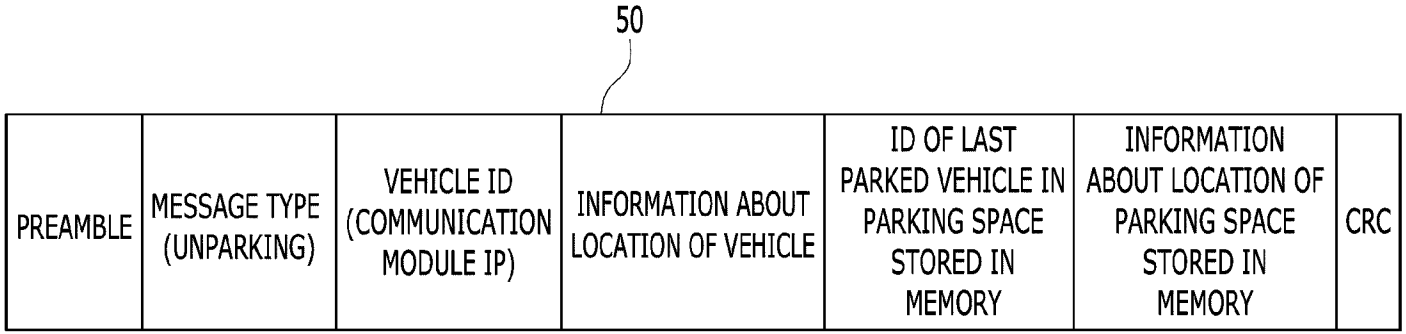
FIG. 5 is an exemplary diagram illustrating the configuration of a parking space information request message, according to an exemplary embodiment of the present invention.

The structure of the information message about unparking may be that illustrated in FIG. 5. The information message about unparking, as illustrated in FIG. 5, includes a preamble, a message type (e.g., unparking), the IP of the communication adapter mounted in the vehicle as an ID of the vehicle, the vehicle location information provided by the GPS 150, the ID of a vehicle stored in the memory 140 as the most recent vehicle parked in a parking space or the IP of the communication adapter of the vehicle, the location information about the parking space stored in the memory 140, and CRC (Cyclic Redundancy Check), but it should be understood that the protective scope of the present invention is not limited thereto. The present invention may be applied to another structure that may be a message structure including the information of unparking.

When the information message about unparking is broadcasted and the communication adapters 120 of the vehicles that are parked in the surrounding area receive the information message about unparking, the controllers 110 of the vehicles may determine whether an acknowledgement signal (e.g., an acknowledgement) for the broadcasted information message about unparking has been received (S214). The receipt of the acknowledgement signal by the communication adapter 120 means that the communication adapter of another vehicle has received and responded to the information message about unparking.

In other words, in an exemplary embodiment of the present invention, when the communication adapter 120 of the corresponding vehicle has received the information message about unparking and has not received an acknowledgement signal for the information message about unparking, the controller 110 of the corresponding vehicle may determine that the communication adapter 120 of the corresponding vehicle has received first the information message about unparking, and broadcasts an acknowledgement signal (S216).

The determination that the information message about unparking has been received first is performed by the RSSI 122 in the communication adapter 120. Referring to FIG. 11, when the vehicle D that is unparked broadcasts an information message about unparking, the RSSI value displayed by the RSSI 122 of the vehicle C is the largest as compared to the vehicles in the surrounding area, because the vehicle C is closest to the vehicle D. The RSSI values of the vehicles E, B, F, and A are sequentially larger in order of the vehicles closer to the vehicle D. The vehicles A, B, C, E, and F that have received the information message about unparking from the vehicle D store the ID of the vehicle D and the RSSI value of the information message about unparking received from the vehicle D, in their memories.

As a result, when the vehicle D broadcasts the information message about unparking, the vehicle C that is the closest to the vehicle D may broadcast first an acknowledgement signal for the information message about the uparking by backoff according to the RSSI in the vehicles in the surrounding area which have received the information message about unparking. The other vehicles may store the ID of the vehicle D and the RSSI value received from the vehicle D for a predetermined time (or the number of times). The other vehicles may receive the acknowledgement signal broadcasted by the vehicle C, and determine they are not the vehicle closest to the empty parking space and simultaneously not perform additional broadcasting. In other words, when the communication adapter 120 of a corresponding vehicle has received the information message about unparking and an acknowledgement signal for the information message about unparking, the communication adapter 120 of the vehicle does not broadcast an acknowledgement signal by the controller 110 determining that there is a communication adapter that has received the information message about unparking earlier than the communication adapter 120 of the corresponding vehicle.

The controller 110 of the vehicle with the communication adapter that has broadcasted the acknowledgement signal in step S216 in FIG. 3 may store and manage the information about unparking in the memory as information about an available parking space, after broadcasting the acknowledgement signal (S218).

Figure 4:
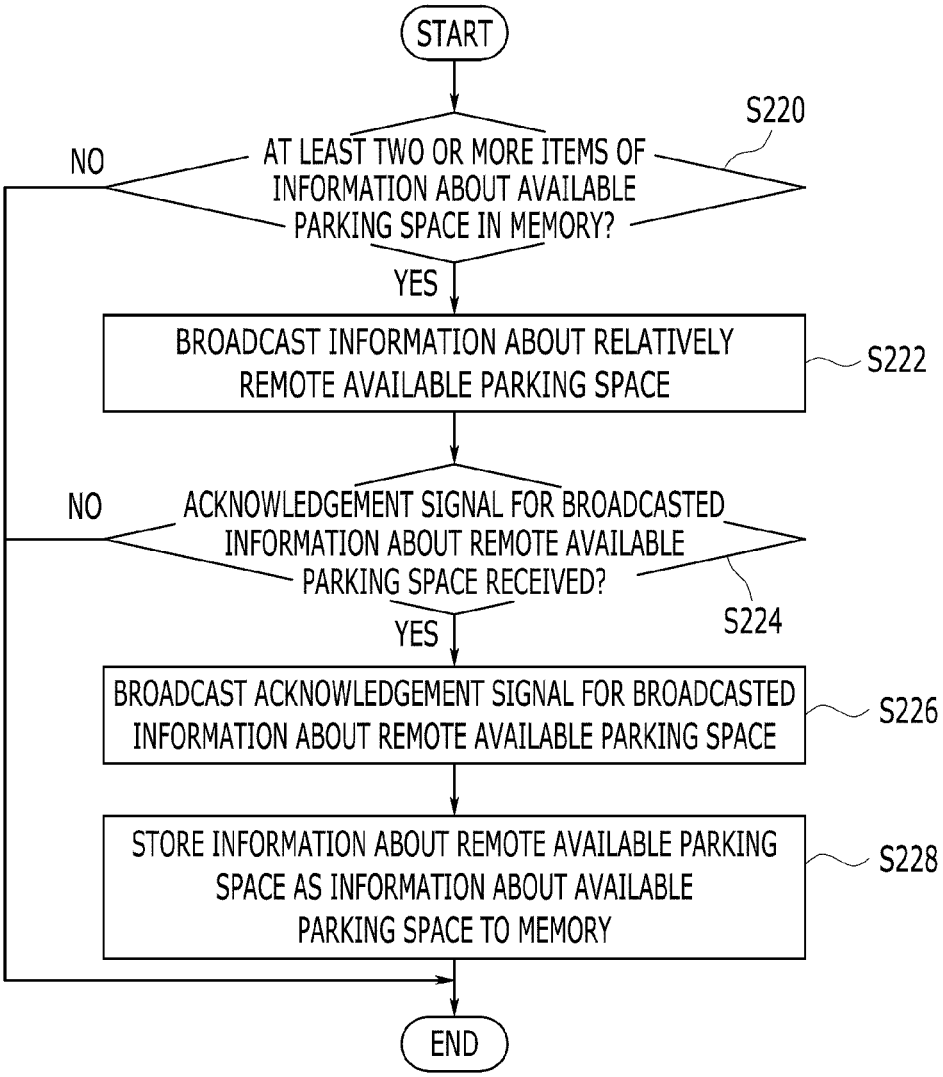
FIG. 4 is an exemplary flowchart illustrating a method of providing information about a parking space through communication between vehicles, according to another exemplary embodiment of the present invention.

Referring to FIGS. 4, 9, and 11, when at least two or more items of information about an available parking space are stored in the memory 140 (S22), the corresponding controller 110 may control the communication adapter 120 to broadcast the information about a substantially remote available parking space (S222). In FIG. 11, an available parking space considered substantially remote from the vehicle B is the space DQ next to the vehicle E.

When the communication adapters 120 of the vehicles in the surrounding area receive the information about a remote available parking space that has been broadcasted from the communication adapter 120 of the vehicle B, the controllers 110 of the vehicles may determine whether an acknowledgement signal (e.g., an acknowledgement) for the information about remote available parking broadcasted to the communication adapters 120 has been received (S224). The receipt of the acknowledgment signal by the communication adapter 120 means that the communication adapter of another vehicle has received and responded first to the information message about unparking.

In other words, in an exemplary embodiment of the present invention, when the communication adapter 120 of the corresponding vehicle has received the information about remote available parking and has not received an acknowledgement signal for the information about remote available parking, the communication adapter 120 of the corresponding vehicle may broadcast the acknowledgement signal by determining that the communication adapter 120 of the corresponding vehicle has received first the information about remote available parking (S226).

On the other hand, when the communication adapter 120 of the corresponding vehicle has received the information about remote available parking and an acknowledgement signal for the information about remote available parking, the communication adapter 120 of the corresponding vehicle does not broadcast an acknowledgement signal by determining that there is a communication adapter that has received the information about remote available parking earlier than the communication adapter 120 of the corresponding vehicle.

In FIG. 11, the communication adapter of the vehicle E may first receive the information about a remote available parking space broadcasted by the communication adapter 120 of the vehicle B and the controller of the vehicle E may control the communication adapter to broadcast an acknowledgement signal.

The controller of the vehicle E that has broadcasted the acknowledgement signal in S226 may store and manage the information about the remote available parking broadcasted from the vehicle B, in the memory as the information about an available parking space, after broadcasting the acknowledgement signal, and the controller of the vehicle B may delete and update the broadcasted information about a remote available parking space that has been stored in the memory (S228). Thus, only the information about the available parking space CQ may be stored and managed in the memory of the vehicle B.

The method illustrated in the exemplary flowchart shown in FIG. 4 is described hereafter with reference to FIG. 11.

When the vehicle C is unparked, the vehicle C may broadcast information about unparking to vehicles in the surrounding area. The vehicle closest to the vehicle C may broadcast first an acknowledgement for the information message about unparking by backoff according to RSSI in the vehicles in the surrounding area which have received the information message about unparking of the vehicle C. The memory of the vehicle B may store two items of information about an available parking space, because the vehicle C has stored the information about an available parking space of the vehicle D.

After broadcasting the acknowledgement, the vehicle B may broadcast the two items of information about an available parking space. After the vehicle B broadcasts the two items of information about an available parking space, the other vehicles, except the vehicle B, may broadcast the stored value of the RSSI received from the vehicle C. Similarly, as described above, since the vehicle E may broadcast first the stored value of the RSSI based on the backoff method according to the RSSI, other vehicles do not broadcast acknowledgement signals. Thus, the vehicle E may store the information about the parking space where the vehicle D has been parked and the vehicle B may store only the information about the space where the vehicle C has been parked.

Figure 8:
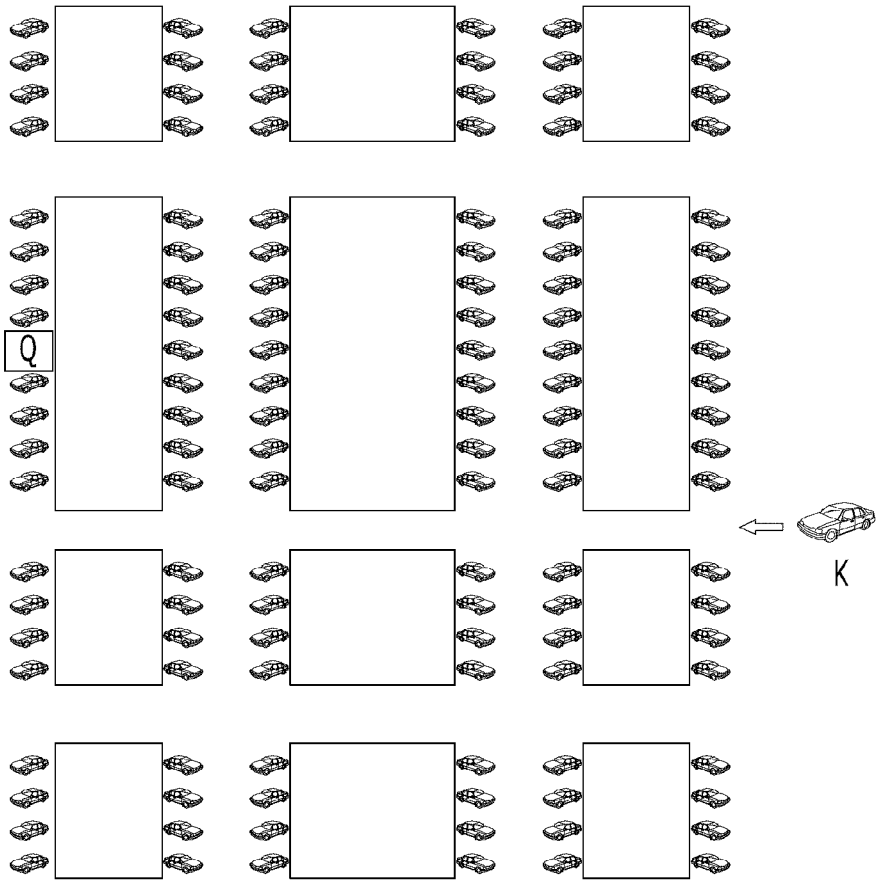
FIGS. 8 to 11 are exemplary views illustrating the method for providing information about a parking space, according to an exemplary embodiment of the present invention.

In an exemplary embodiment of the present invention, when the vehicle K parked in FIGS. 8 and 10 is provided with information about an available parking space, the controller 110 of the vehicle K may control the navigation device 130 to display the location of the available parking space and may guide the driver to the location.

Therefore, according to an exemplary embodiment of the present invention, it may be possible to efficiently provide information about a parking space, using communication between vehicles even without a parking management system.

While this invention has been described in connection with what is presently considered to be exemplary embodiments, it is to be understood that the invention is not limited to the disclosed embodiments, but, on the contrary, is intended to cover various modifications and equivalent arrangements included within the spirit and scope of the appended claims.

What is claimed is:

1. A method of providing information about a parking space to a vehicle using a communication adapter to broadcast and unicast communication between vehicles, the method comprising:

receiving, by a controller, a parking space request message through the broadcast communication;

determining, by the controller, when information about the available parking space is stored in a memory, in response to receiving the broadcasted parking space information request message;

transmitting, by the communication adapter, the information about the available parking space through unicast communication corresponding to the broadcasted parking space information request message, when the information about the available parking space is stored in the memory; and rebroadcasting, by the communication adapter, the received parking space information request message, when information about the available parking space is not stored in the memory, wherein the rebroadcasting is performed within a predetermined number of hops.

2. The method of claim 1, further comprising:

receiving, by the communication adapter, the information about the available parking space received by the unicast communication in response to the rebroadcasted request message; and transmitting, by the communication adapter, the information about the available parking through the unicast communication corresponding to the broadcasted parking space information request message.

3. A method of providing information about a parking space through communication between vehicles including a communication adapter to broadcast and unicast communication, the method comprising broadcasting, by a communication adapter, a parking space information request message using the communication adapter of a vehicle to be parked, when a driver inputs a request signal for the information about the parking space;

determining, by the controller, when information about an available parking space is stored in a memory in a plurality of parked vehicles, when the communication adapters of the plurality of parked vehicles receive a parking space information request message broadcasted by the vehicle to be parked;

unicasting, by the communication adapter, the information about the available parking space to the communication adapter of the vehicle to be parked, through the communication adapter of the parked vehicle including a memory configured to store the information about the available parking;

rebroadcasting, by the controller, the received parking space information request message within a predetermined range, by the parked vehicle including a memory that does not store the information about an available parking space; and updating, by the controller, the memory of the parked vehicle, wherein the memory is configured to store the information about the available parking space, when the vehicle to be parked is parked in the available parking space based on the information about the available parking, wherein the rebroadcasting is performed within a predetermined number of hops.

4. The method of claim 3, wherein further comprising:

broadcasting, by the communication adapter, an information message about an unparked vehicle, through a corresponding communication adapter, to update the information about the available parking by distributing the information message about the unparked vehicle to a plurality of parked vehicles in a surrounding area;

broadcasting, by the communication adapter, an acknowledgement signal for the information message about unparking first through the communication adapter of the parked vehicle closest to the unparked vehicle, when the communication adapters of the plurality of parked vehicles in the surrounding area receive the broadcasted information message about unparking;

determining, by the controller, the remaining plurality of vehicles are not closest to the unparked vehicle, after receiving the acknowledgement signal, and not broadcasting an acknowledgement signal for the information message about unparking broadcasted by the unparked vehicle;

broadcasting, by the communication adapter, first the acknowledgement signal for the broadcasted information message about unparking, by the closest parked;

storing, by the memory on the controller, the information about unparking of the unparked vehicle, to a memory as information about the available parking space; and storing, by the memory of the controller, information about the unparked vehicle and the values of a reception strength of the broadcasted information message about unparking, in memories of the plurality of parked vehicles determined to not be the closest parked vehicle, based on the information message about unparking broadcasted by the unparked vehicle.

5. The method of claim 4, wherein further comprising:

broadcasting, by the communication adapter, information about a remote available parking space through the communication adapter, when at least two items of information about the available parking space are stored in the memory;

determining, by the controller, when an acknowledgement signal has been broadcasted from the communication adapter of a parked vehicle, when a communication adapter receives the broadcasted information about a remote available parking space;

not broadcasting, by the communication adapter, an acknowledgement signal relating to the information about a remote available parking space, when the communication adapter has received the acknowledgement signal;

broadcasting, by the communication adapter, an acknowledgement signal corresponding to the information about the remote available parking space through the communication adapter, when the communication adapter has not received the acknowledgement signal; and storing, by the memory of the controller, the information about the remote available parking space to the memory as information about the available parking space.

6. The method of claim 4, wherein unparking of the vehicle is determined based on a plurality of signals corresponding to a parking brake, a shift lever, and a vehicle speed.

7. The method of claim 4, wherein the information message about unparking includes a Internet Protocol of the communication adapter of the vehicle, information about a location of the vehicle, information about the location of the available parking space stored in the memory, and the IP of the communication adapter of the most recently parked vehicle in the available parking space stored in the memory.

8. The method of claim 7, wherein the information about the location of the available parking space is obtained by a GPS disposed in the vehicle.

9. The method of claim 4, wherein the broadcasting of the acknowledgement signal is performed based on backoff of Received Signal Strength Indication of the information message about unparking received by the communication adapter.

10. A system for providing information about a parking space mounted on vehicles, the system comprising:

a communication adapter configured to broadcast and unicast a parking space information request message within a predetermined range when a request signal is input;

a controller configured to:

control a GPS to provides information about a location of an available parking space;

control a navigation device to display and guide a driver to the location of the available parking space;

receive, from a parking brake switch, a signal corresponding to an operation of a parking brake;

receive, from a vehicle speed sensor, the speed of a vehicle; and receive, from a shift lever position detector, the position of a shift lever.

11. The system of claim 10, wherein the controller is further configured to:

receive the parking space request message through the broadcast communication; and determine when information about the available parking space is stored in a memory, in response to receiving the broadcasted parking space information request message.

12. The system of claim 10, wherein the communication adapter is further configured to:

transmit the information about the available parking space through unicast communication corresponding to the broadcasted parking space information request message, when the information about the available parking space is stored in the memory;

rebroadcast the received parking space information request message, when information about an available parking space is not stored in the memory;

receive the information about the available parking space received by the unicast communication in response to the rebroadcasted request message; and transmit the information about the available parking through the unicast communication corresponding to the broadcasted parking space information request message.

13. The system of claim 12, wherein the communication adapter is further configured to:

broadcast an information message about an unparked vehicle, through a corresponding communication adapter, to update the information about the available parking by distributing the information message about the unparked vehicle to a plurality of parked vehicles in a surrounding area;

broadcast an acknowledgement signal for the information message about unparking first through the communication adapter of the parked vehicle closest to the unparked vehicle, when the communication adapters of the plurality of parked vehicles in the surrounding area receive the broadcasted information message about unparking; and broadcast first the acknowledgement signal for the broadcasted information message about unparking, by the closest parked, in response to the controller determining the remaining plurality of vehicles are not closest to the unparked vehicle, after receiving the acknowledgement signal, and not broadcasting an acknowledgement signal for the information message about unparking broadcasted by the unparked vehicle.

14. The system of claim 13, wherein the controller is further configured to:

store the information about unparking of the unparked vehicle, to a memory as information about the available parking space; and store information about the unparked vehicle and the values of a reception strength of the broadcasted information message about unparking, in memories of the plurality of parked vehicles determined to not be the closest parked vehicle, based on the information message about unparking broadcasted by the unparked vehicle.

15. A non-transitory computer readable medium containing program instructions executed by a processor or controller, the computer readable medium comprising:

program instructions that control a communication adapter to broadcast and unicast a parking space information request message within a predetermined range when a request signal is input;

program instructions that control a GPS to provides information about a location of an available parking space;

program instructions that control a navigation device to display and guide a driver to the location of the available parking space;

program instructions that receive, from a parking brake switch, a signal corresponding to an operation of a parking brake;

program instructions that receive, from a vehicle speed sensor, the speed of a vehicle; and program instructions that receive, from a shift lever position detector, the position of a shift lever.

16. The computer readable medium of claim 15, further comprising:

program instructions that receive the parking space request message through the broadcast communication;

program instructions that determine when information about the available parking space is stored in a memory, in response to receiving the broadcasted parking space information request message;

program instructions that control a communication adapter to transmit the information about the available parking space through unicast communication corresponding to the broadcasted parking space information request message, when the information about the available parking space is stored in the memory;

program instructions that control a communication adapter to rebroadcast the received parking space information request message, when information about an available parking space is not stored in the memory;

program instructions that receive the information about the available parking space received by the unicast communication in response to the rebroadcasted request message; and program instructions that control a communication adapter to transmit the information about the available parking through the unicast communication corresponding to the broadcasted parking space information request message.

17. The computer readable medium of claim 16, further comprising:

program instructions that control a communication adapter to broadcast an information message about an unparked vehicle, through a corresponding communication adapter, to update the information about the available parking by distributing the information message about the unparked vehicle to a plurality of parked vehicles in a surrounding area;

program instructions that control a communication adapter to broadcast an acknowledgement signal for the information message about unparking first through the communication adapter of the parked vehicle closest to the unparked vehicle, when the communication adapters of the plurality of parked vehicles in the surrounding area receive the broadcasted information message about unparking;

program instructions that determine the remaining plurality of vehicles are not closest to the unparked vehicle, after receiving the acknowledgement signal, and not broadcasting an acknowledgement signal for the information message about unparking broadcasted by the unparked vehicle;

program instructions that control a communication adapter to broadcast first the acknowledgement signal for the broadcasted information message about unparking, by the closest parked;

program instructions that store the information about unparking of the unparked vehicle, to a memory as information about the available parking space; and program instructions that store information about the unparked vehicle and the values of a reception strength of the broadcasted information message about unparking, in memories of the plurality of parked vehicles determined to not be the closest parked vehicle, based on the information message about unparking broadcasted by the unparked vehicle.

* * * * *